US011317688B2

(12) United States Patent
Wang et al.

(10) Patent No.: US 11,317,688 B2
(45) Date of Patent: May 3, 2022

(54) STRAIGHT-POLE SUN UMBRELLA HAND-CRANKING DEVICE

(71) Applicant: Linhai Guokang Leisure Products Co., Ltd., Taizhou (CN)

(72) Inventors: Ziguo Wang, Taizhou (CN); Defu Liu, Taizhou (CN)

(73) Assignee: Linhai Guokang Leisure Products Co., Ltd.

( * ) Notice: Subject to any disclaimer, the term of this patent is extended or adjusted under 35 U.S.C. 154(b) by 0 days.

(21) Appl. No.: 17/087,081

(22) Filed: Nov. 2, 2020

(65) Prior Publication Data

US 2021/0401135 A1 Dec. 30, 2021

(51) Int. Cl.
*A45B 25/14* (2006.01)
*A45B 23/00* (2006.01)

(52) U.S. Cl.
CPC ..... *A45B 25/14* (2013.01); *A45B 23/00* (2013.01); *A45B 2025/146* (2013.01)

(58) Field of Classification Search
CPC .... A45B 25/14; A45B 2025/146; A45B 23/00
See application file for complete search history.

(56) References Cited

U.S. PATENT DOCUMENTS 4,619,281 A * 10/1986 Redl ..... A45B 25/14 135/20.3
4,807,655 A * 2/1989 Robertson ..... A45B 23/00 135/20.3
4,928,718 A * 5/1990 Apple ..... A45B 23/00 135/20.3
5,437,297 A * 8/1995 Crisman ..... A45B 25/14 135/20.1
5,884,859 A * 3/1999 Ma ..... A45B 25/14 242/395
6,170,497 B1 * 1/2001 Ma ..... A45B 25/14 135/15.1
6,591,848 B2 * 7/2003 Ma ..... A45B 25/14 135/16
6,722,381 B2 * 4/2004 Lai ..... A45B 25/14 135/20.3
7,438,077 B1 * 10/2008 Wilson ..... A45B 25/14 135/20.1
2012/0266927 A1 * 10/2012 Lukacsy ..... A45B 25/16 135/20.3

* cited by examiner

*Primary Examiner* — Noah Chandler Hawk

(57) ABSTRACT

A straight-pole sun umbrella hand-cranking device comprises a standing pole and a shell fixed on the standing pole, wherein the shell comprises a first outer shell and a second outer shell. The shell is fixed on one side of the standing pole, and a rope winding wheel is mounted within the first and the second outer shells. The rope winding wheel is connected to a cranking shaft, and the cranking shaft is propelled to rotate through a cranking handle connected with the cranking shaft. An anti-slip mechanism is arranged on the cranking shaft. The anti-slip mechanism comprises a torsion spring, the torsion spring is sleeved on the cranking shaft. The rope winding wheel achieves easy winding or unwinding of the ropes, and the anti-slip performance is improved by the elastic force of the spring. As the aforesaid structure is protected against abrasion, its functional life is significantly prolonged.

4 Claims, 2 Drawing Sheets

STRAIGHT-POLE SUN UMBRELLA HAND-CRANKING DEVICE

TECHNICAL FIELD

This disclosure generally relates to the technical field of sun umbrellas, and more particularly, to a straight-pole sun umbrella hand-cranking device.

BACKGROUND

Conventional standing-pole sun umbrellas typically comprise a hand-cranking device whose shell is arranged on the periphery of a standing pole, and a rope winding wheel arranged within the standing pole. A hand crank sequentially passes through the front shell of the hand-cranking device, the standing pole, and the rope winding wheel until being connected to the rear shell of the hand-cranking device. An anti-slip mechanism achieves the anti-slip function through the interaction among a shifting piece, a shifting claw, a compression spring and a gear ring of the rope winding wheel. However, the aforesaid device may get worn after being used for more than 50 times. Once the shifting piece fails to hold the gear ring, the umbrella rope may be loosened to close the umbrella. Moreover, all parts need to be assembled within the standing pole, which makes the assembly time-consuming.

SUMMARY

The purpose of the present disclosure is to provide a straight-pole sun umbrella hand-cranking device.

To achieve the above purpose, the present disclosure adopts the following technical solution: a straight-pole sun umbrella hand-cranking device comprising a standing pole and a shell fixed on the standing pole, wherein the shell comprises a first outer shell and a second outer shell, which is in a snap-fit with the first outer shell, wherein the shell is fixed on one side of the standing pole, and a rope winding wheel is mounted within the first outer shell and the second outer shell, wherein the rope winding wheel is connected to a cranking shaft, and the cranking shaft is propelled to rotate through a cranking handle connected with the cranking shaft, wherein an anti-slip mechanism is arranged on the cranking shaft, and the anti-slip mechanism is arranged within the inner cavity of the first outer shell, wherein the anti-slip mechanism comprises a torsion spring, the torsion spring is sleeved on the cranking shaft, and the outer surface of the torsion spring is in contact with the inner cavity of the first outer shell.

In another aspect of the present disclosure, a second umbrella rope is wound around the rope winding wheel, and a first pulley is arranged within the standing pole. The second umbrella rope penetrates through the wall surface of the standing pole and is connected with the first umbrella rope after passing along the first pulley.

In another aspect of the present disclosure, the standing pole is provided with an upper umbrella disc and a lower umbrella disc. The upper umbrella disc is provided with two second pulleys, and two ends of the first umbrella rope are fixed within the lower umbrella disc. A middle portion of the first umbrella rope passes along the second pulleys to form a U-shaped structure, and the second umbrella rope is fixedly connected with the center of the U-shaped structure.

In another aspect of the present disclosure, each of the first pulley and the second pulleys is respectively provided with a cylindrical pin.

In another aspect of the present disclosure, the rope winding wheel interacts with and abuts against the torsion spring.

Compared with the prior art, the present disclosure has the following advantages: the aforesaid structure is integrally assembled on one side surface, making the assembly of the shell convenient; the rope winding wheel achieves easy winding or unwinding of the ropes; the anti-slip performance is improved by the elastic force of the spring; as the aforesaid structure is protected against abrasion, its functional life is significantly prolonged.

Figure 1:
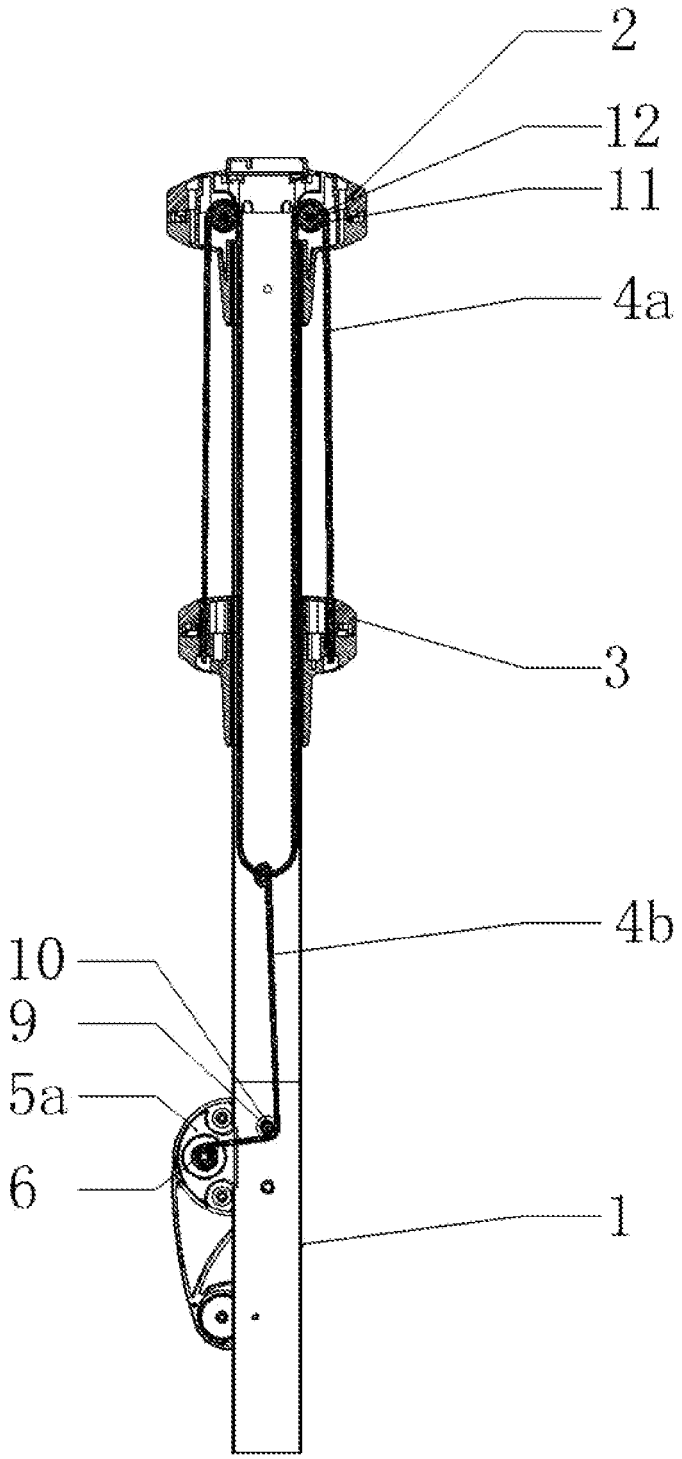
FIG. 1 a conceptual diagram illustrating an example structure of the present disclosure during use.
Figure 2:
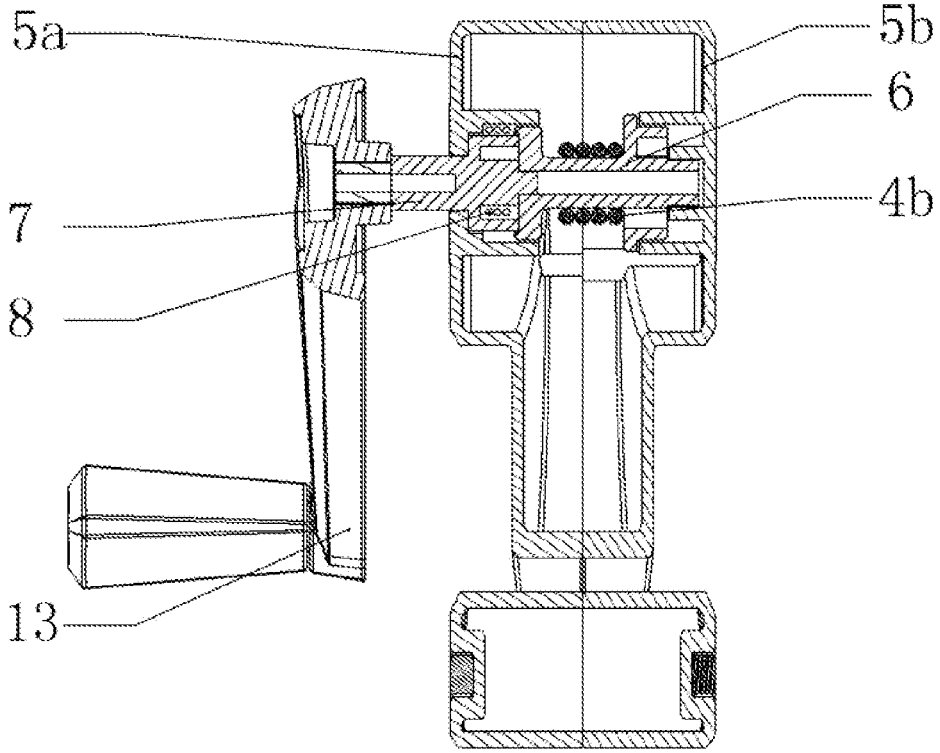
FIG. 2 is a conceptual diagram illustrating an example structure of the present disclosure.

In the Figures: 1—Standing Pole, 2—Upper Umbrella Disc, 3—Lower Umbrella Disc, 4*a*—First Umbrella Rope, 4*b*—Second Umbrella Rope, 5*a*—First Outer Shell, 5*b*—Second Outer Shell, 6—Rope Winding Wheel, 7—Cranking Shaft, 8—Torsion Spring, 9—Cylindrical Pin, 10—First Pulley, 11—Second Pulley, 12—Cylindrical Pin, 13—Cranking Handle.

DETAILED DESCRIPTION

Figures are combined hereinafter to further elaborate the technical solution of the present disclosure.

The straight-pole sun umbrella hand-cranking device of the present disclosure comprises a standing pole 1 and a shell fixed on the standing pole 1, wherein the shell comprises a first outer shell 5*a* and a second outer shell 5*b* which is in a snap-fit with the first outer shell 5*a*. The shell is fixed on one side of the standing pole 1. Cavities are symmetrically formed in the first outer shell 5*a* and the second outer shell 5*b*, and a rope winding wheel 6 is mounted in the cavities symmetrically formed in the first outer shell 5*a* and the second outer shell 5*b*. The rope winding wheel 6 is connected to a cranking shaft 7, wherein one portion of the cranking shaft 7 is located within the first outer shell 5*a*, and the other portion of the cranking shaft 7 is propelled to rotate through a cranking handle 13 connected with the cranking shaft 7. An anti-slip mechanism is arranged on the cranking shaft 7, and the anti-slip mechanism is arranged within the inner cavity of the first outer shell 5*a*. The anti-slip mechanism comprises a torsion spring 8, and the torsion spring 8 is sleeved on the cranking shaft 7. Namely, the torsion spring 8 is sleeved on a portion of the cranking shaft 7 which is located within the first outer shell 5*a*, and the outer surface of the torsion spring 8 is in contact with the inner cavity of the first outer shell 5*a*. The torsion spring 8 is installed based on its own elasticity. A second umbrella rope 4*b* is wound around the rope winding wheel 6, and a first pulley 10 is arranged within the standing pole 1. The second umbrella rope 4*b* penetrates through the wall surface of the standing pole 1 and is connected with a first umbrella rope 4*a* after passing along the first pulley 10.

The standing pole 1 is provided with an upper umbrella disc 2 and a lower umbrella disc 3. The upper umbrella disc 2 is provided with two second pulleys 11, and the two ends of the first umbrella rope 4*a* are fixed within the lower umbrella disc 3. The middle portion of the first umbrella rope 4*a* passes along the second pulleys 11 to form a U-shaped structure, and the second umbrella rope 4*b* is fixedly connected with the center of the U-shaped structure.

Each of the first pulley 10 and the second pulleys 11 is respectively provided with a cylindrical pin (e.g., a cylindrical pin 9 and a cylindrical pin 12). The side of the rope winding wheel 6 installed on the first outer shell 5*a* is configured to be a recessed structure, and the cranking shaft 7 is wrapped by the outer edge of the rope winding wheel 6. The rope winding wheel 6 interacts with and abuts against the cranking shaft 7, namely, the torsion spring 8, thereby preventing the torsion spring 8 from escaping from the inner cavity of the first outer shell 5*a*. In this way, high anti-slip performance and prolonged functional life are achieved.

The structure of the aforesaid embodiment is only an explanation but not a limitation of the present disclosure. After reading the specification of the present disclosure, those skilled in the art may make modifications without paying creative labor. Thus, these modifications shall fall into the scope of the present disclosure.

What is claimed is:

1. A straight-pole sun umbrella hand-cranking device, comprising:

a standing pole (1), and a shell fixed on the standing pole (1), wherein the shell comprises:

an outer shell (5*a*), and an outer shell (5*b*) which is in a snap-fit with the outer shell (5*a*), wherein the shell is fixed on one side of the standing pole (1), and a rope winding wheel (6) is mounted within the outer shell (5*a*) and the outer shell (5*b*), wherein the rope winding wheel (6) is connected to a cranking shaft (7), and the cranking shaft (7) is propelled to rotate through a cranking handle (13) connected with the cranking shaft (7), wherein an anti-slip mechanism is arranged on the cranking shaft (7), and the anti-slip mechanism is arranged within the inner cavity of the outer shell (5*a*), wherein the anti-slip mechanism comprises:

a torsion spring (8), the torsion spring (8) is sleeved on the cranking shaft (7), and the outer surface of the torsion spring (8) is in contact with the inner cavity of the outer shell (5*a*), wherein a second umbrella rope (4*b*) is wound around the rope winding wheel (6), and a pulley (10) is arranged within the standing pole (1), wherein the second umbrella rope (4*b*) penetrates through the wall surface of the standing pole (1) and is connected with a first umbrella rope (4*a*) after passing along the pulley (10).

2. The straight-pole sun umbrella hand-cranking device of claim 1, wherein the standing pole (1) is provided with an upper umbrella disc (2) and a lower umbrella disc (3), wherein the upper umbrella disc (2) is provided with two pulleys (11), and the two ends of the first umbrella rope (4*a*) are fixed within the lower umbrella disc (3), wherein the middle portion of the first umbrella rope (4*a*) passes along the pulley (11) to form a U-shaped structure, and the second umbrella rope (4*b*) is fixedly connected with the center of the U-shaped structure.

3. The straight-pole sun umbrella hand-cranking device of claim 2, wherein the pulley (10) and the pulley (11) are respectively provided with a cylindrical pin (9) and a cylindrical pin (12).

4. The straight-pole sun umbrella hand-cranking device of claim 1, wherein the rope winding wheel (6) interacts with and abuts against the torsion spring (8).

* * * * *